US006672326B2

(12) United States Patent
Pappalardo et al.

(10) Patent No.: US 6,672,326 B2
(45) Date of Patent: Jan. 6, 2004

(54) VALVE UNIT FOR CONTROLLING THE DELIVERY OF A COMBUSTIBLE GAS

(75) Inventors: Salvatore Pappalardo, Padua (IT); Giuseppe Veronese, Montegrotto Terme (IT)

(73) Assignee: Sit la Precisa S.p.A., Padua (IT)

( * ) Notice: Subject to any disclaimer, the term of this patent is extended or adjusted under 35 U.S.C. 154(b) by 89 days.

(21) Appl. No.: 09/727,766

(22) Filed: Dec. 4, 2000

(65) Prior Publication Data

US 2001/0002595 A1 Jun. 7, 2001

(30) Foreign Application Priority Data

| | | |
|---|---|---|
| Dec. 2, 1999 | (IT) | 99A000274 |
| Apr. 12, 2000 | (EP) | 00107183 |
| Nov. 13, 2000 | (EP) | 00124277 |
| Nov. 20, 2000 | (EP) | 00124367 |

(51) Int. Cl.[7] ..... F16K 31/04
(52) U.S. Cl. ..... 137/66; 137/614.11; 251/129.11

(58) Field of Search ..... 137/66, 614.11; 251/129.11

(56) References Cited

U.S. PATENT DOCUMENTS 5,979,484 A * 11/1999 Grando et al. ..... 251/129.11
6,029,705 A * 2/2000 Happe ..... 137/614.11

* cited by examiner

*Primary Examiner*—Gerald A. Michalsky
(74) *Attorney, Agent, or Firm*—Sughrue Mion, PLLC

(57) ABSTRACT

A valve unit for controlling the delivery of a combustible gas through a gas path comprises a first valve seat in the gas path and a first closure means associated with the seat, a first actuator means for the control of the closure means for opening and closing of the valve seat and also motor means for the operating control of the first actuator means. The unit further comprises a second electromagnetic actuator means interposed between the closure means and the first actuator means to urge the closure means so as to close the valve seat, independently of the operating position of the first actuator means, when a predetermined condition occurs which requires the interception of the valve seat.

28 Claims, 11 Drawing Sheets

VALVE UNIT FOR CONTROLLING THE DELIVERY OF A COMBUSTIBLE GAS

DESCRIPTION

The present invention relates to a valve unit for controlling the delivery of a combustible gas according to the preamble of the main claim.

It is well known that such units are used for controlling the delivery of combustible gas to a burner or other similar consumer unit so as to vary in a controlled manner its delivery pressure or the flow rate of gas delivered.

Valve units of this type, known from the production of the same Applicant, are typically provided with motor driven actuators for the operating control of a closure means for closing and opening a valve seat provided in the delivery pipe. The actuators comprise, for example, an operating rod acting on the closure means and connected by way of a screw/nut-screw coupling to the rotor of an electric motor in order to displace the closure means for closing and opening of the valve seat as a result of rotational actuation of the electric motor. Through the control of the actuator there is likewise obtained control of modulation of the delivery pressure or respectively of the flow rate of gas delivered.

A problem encountered in valve units with motor driven actuators of the type indicated is that of guaranteeing effective interception of the passage of gas through the valve seat, when predetermined conditions occur, for example those in which safety closure of the valve seat must be ensured as a consequence of the interruption of the electrical supply of the motor driven actuator.

In the modulation phase, interruption of the electrical supply of the motor driven actuator may cause the closure means to stop in an intermediate position of opening of the seat, and therefore the interception of the flow of gas through said seat cannot be guaranteed.

Likewise known are motor driven actuators of reversible type which are brought into the position of closure of the valve seat, on interruption of the electrical supply, by the action of the resilient force of a pre-loaded spring. The closure thus obtained however is typically unreliable and not suitable for safety valves.

The problem underlying the present invention is that of providing a valve unit structurally and functionally designed so as to remedy all the drawbacks mentioned with reference to the prior art cited.

This problem is solved by the invention by means of a valve unit produced in accordance with the claims which follow.

Figure 1:
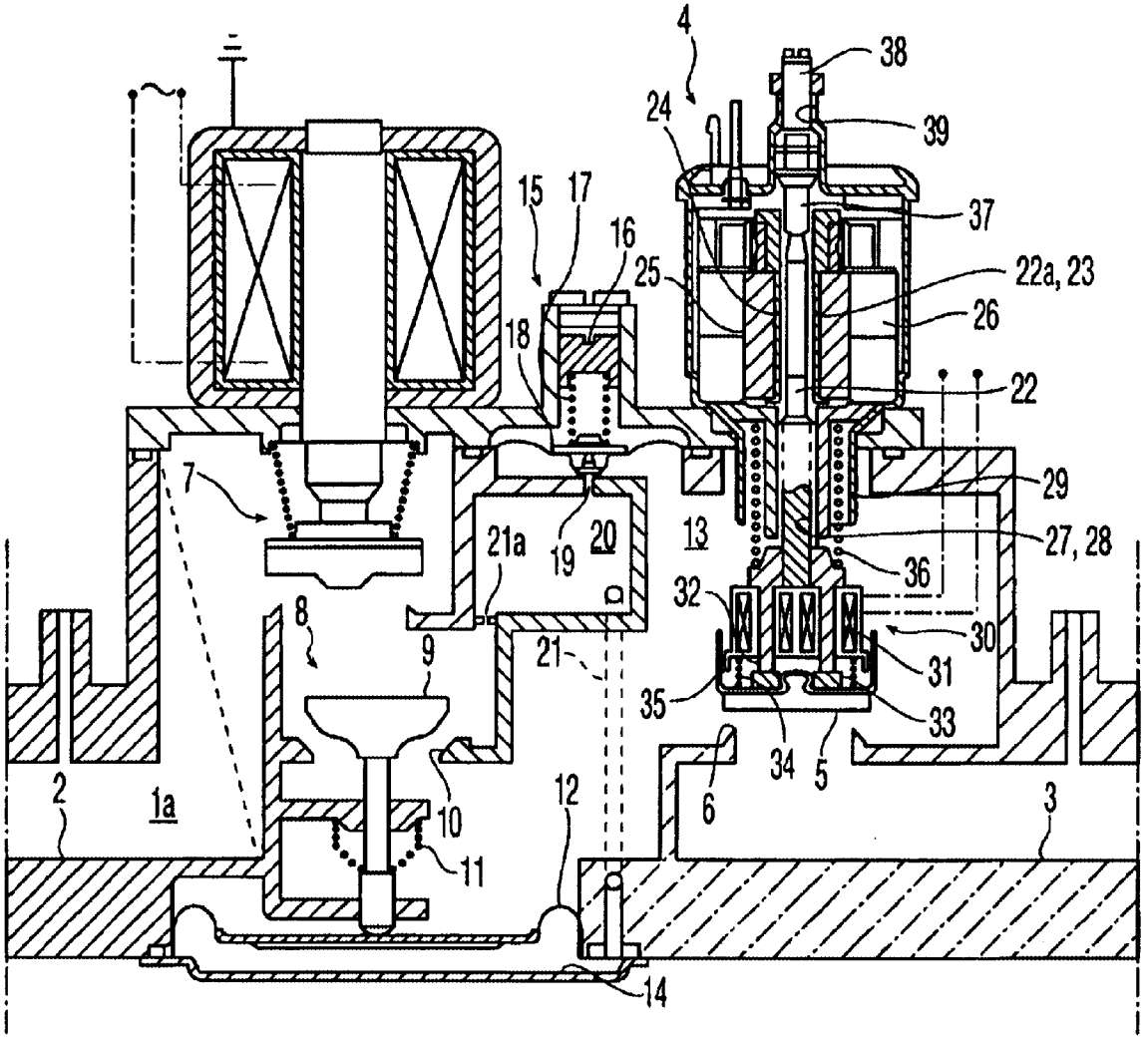
Figure 2:
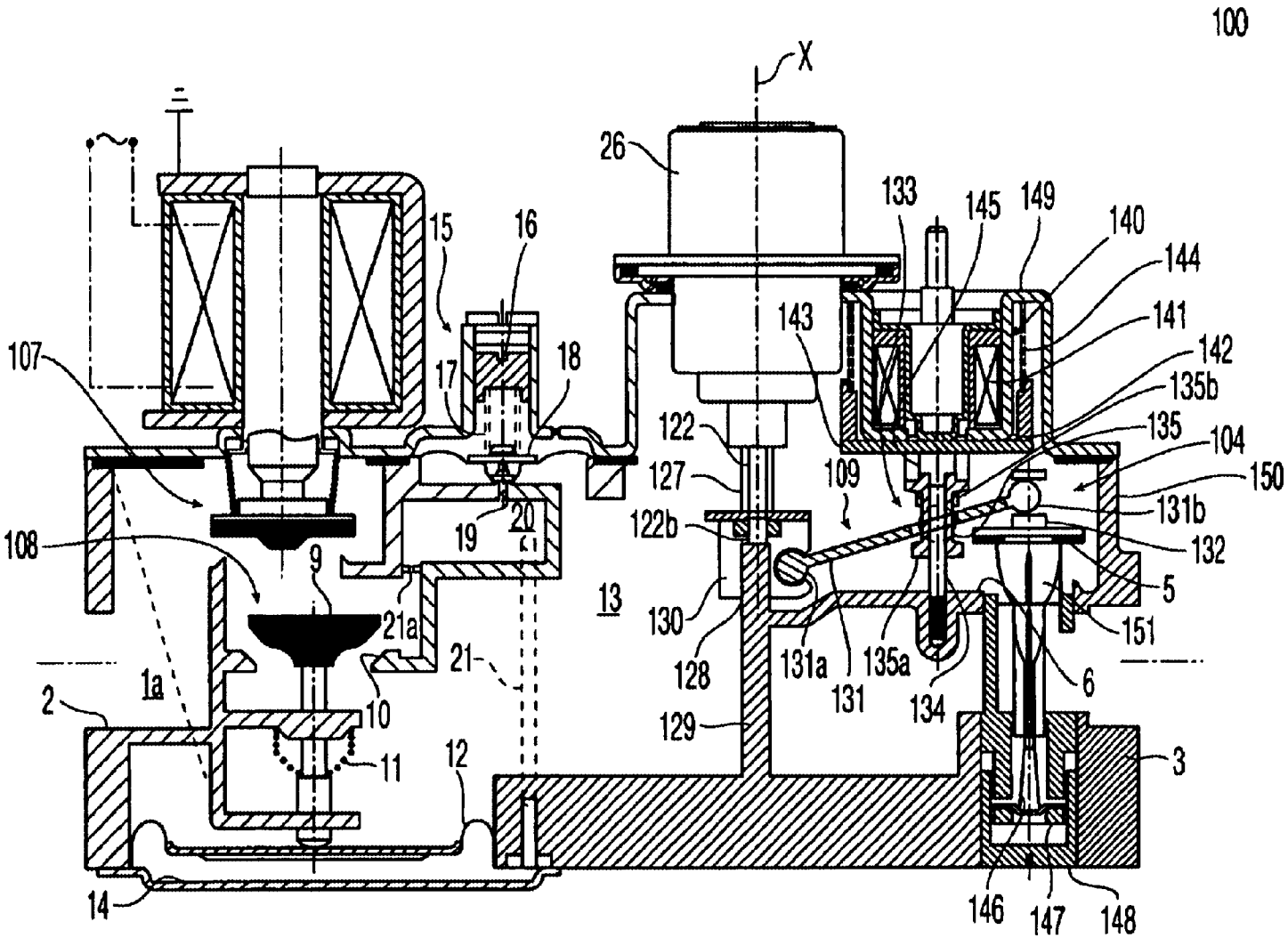
Figure 10:
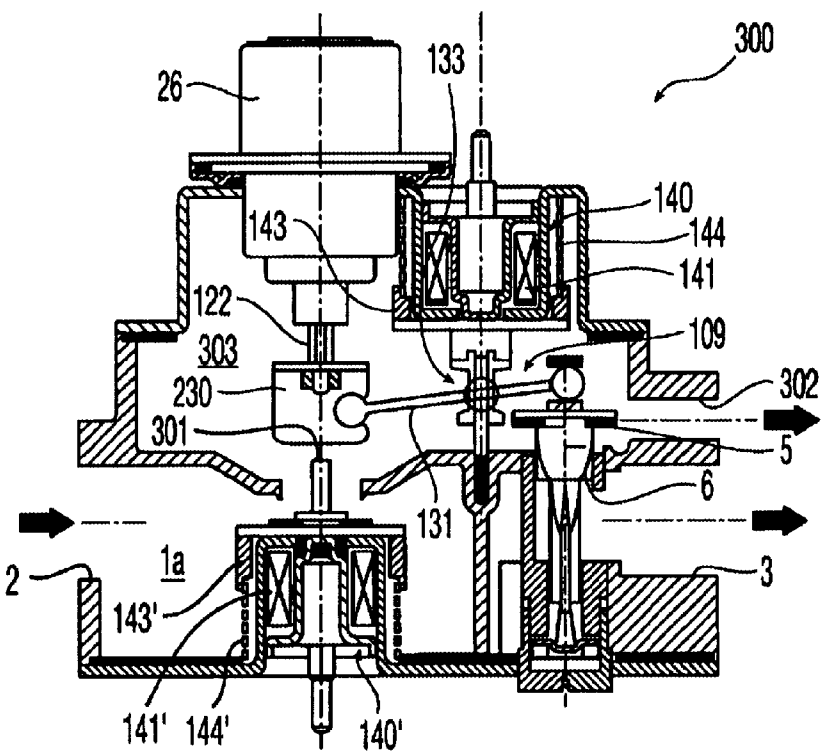
Figure 11:
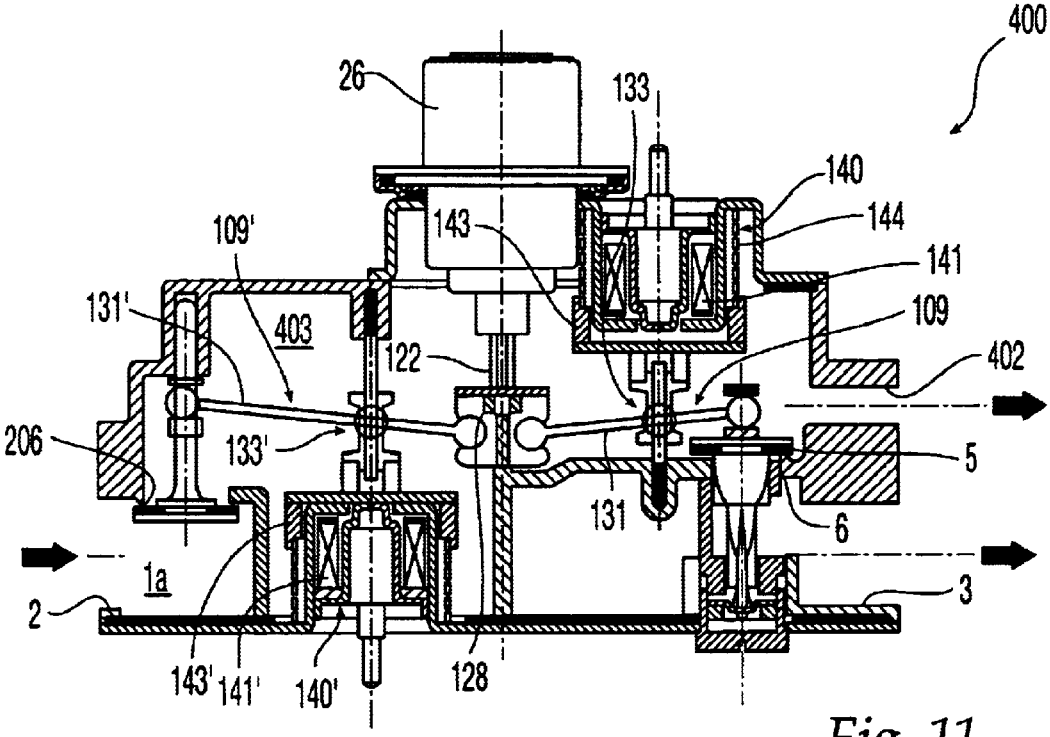
Figure 12:
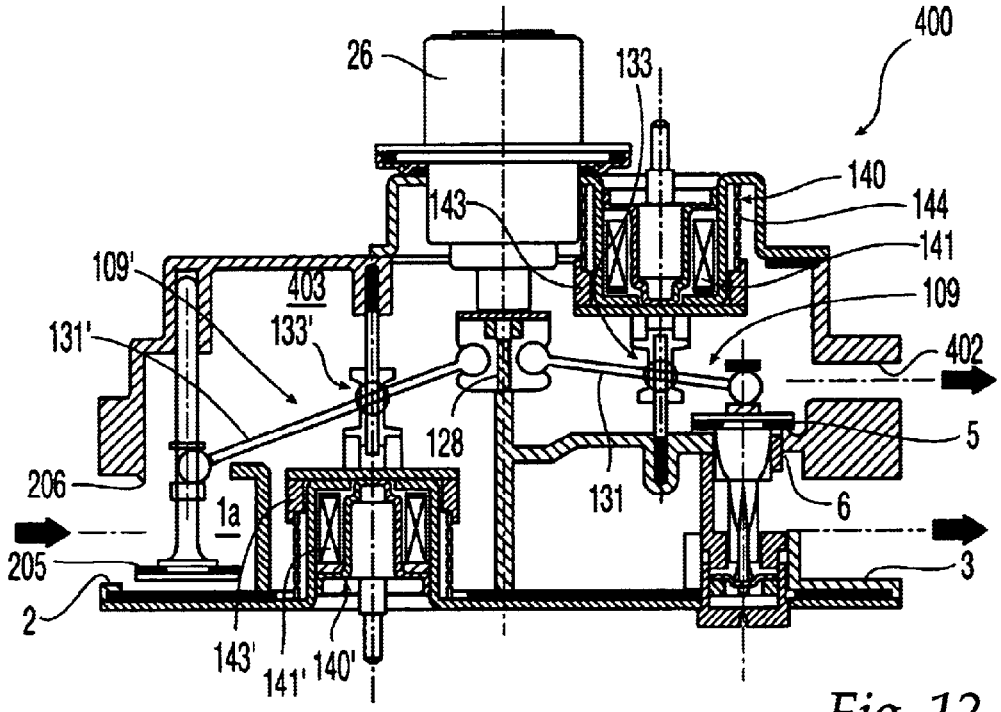
Figure 13:
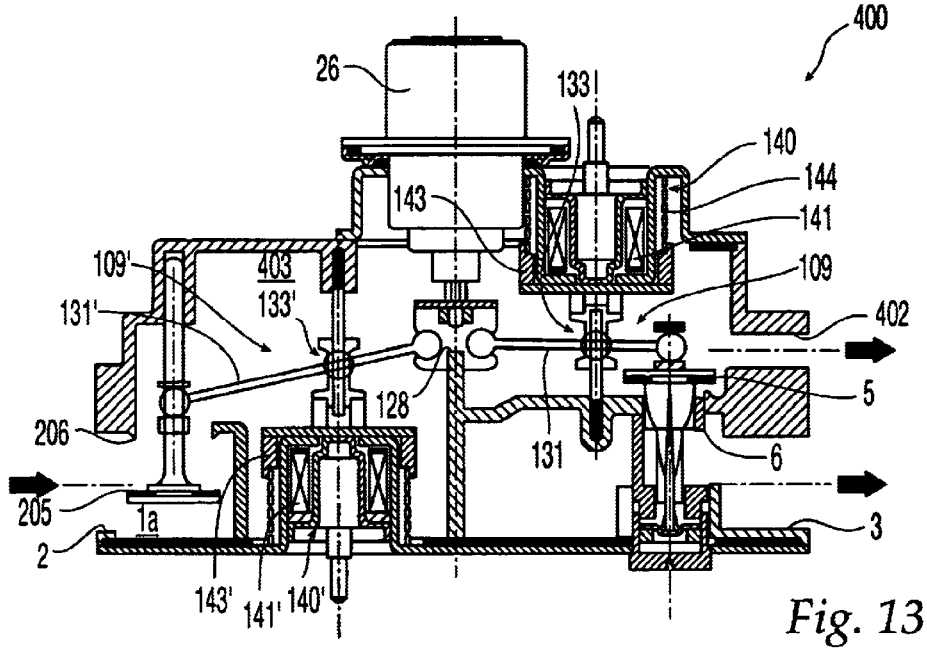
Figure 14:
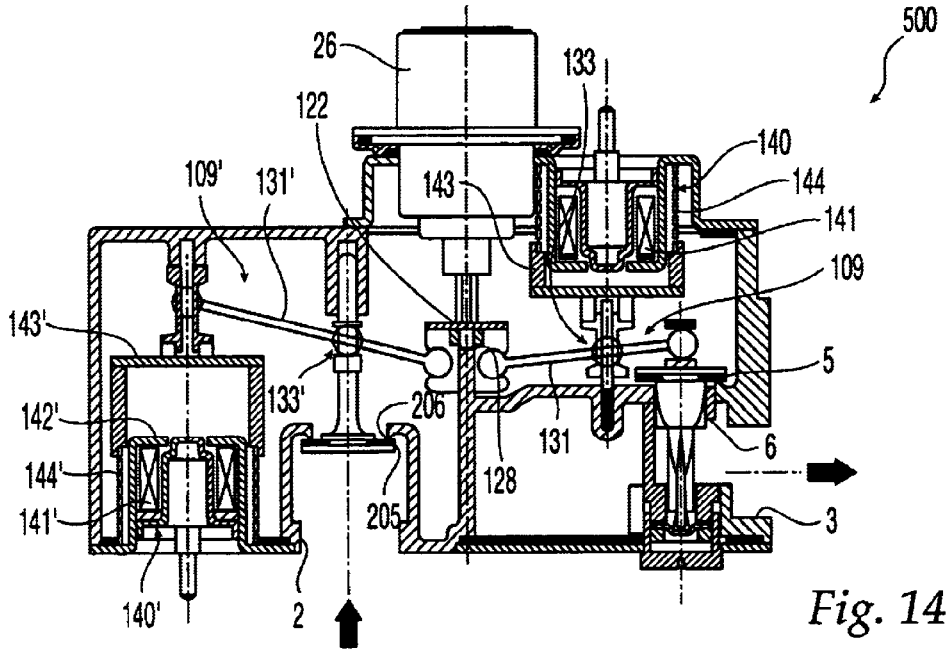
Figure 15:
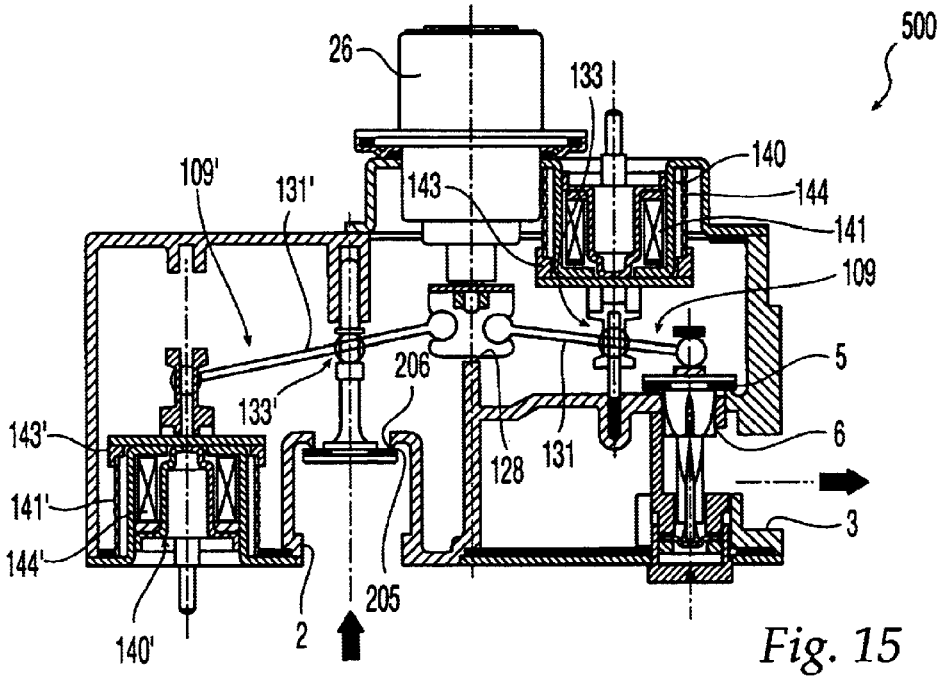
Figure 16:
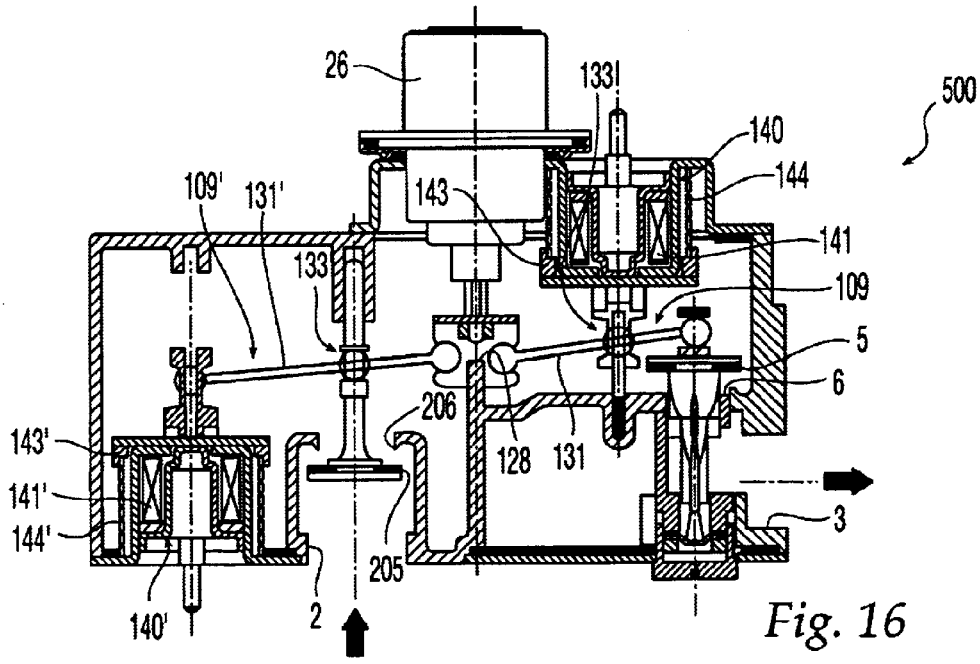
Figure 17:
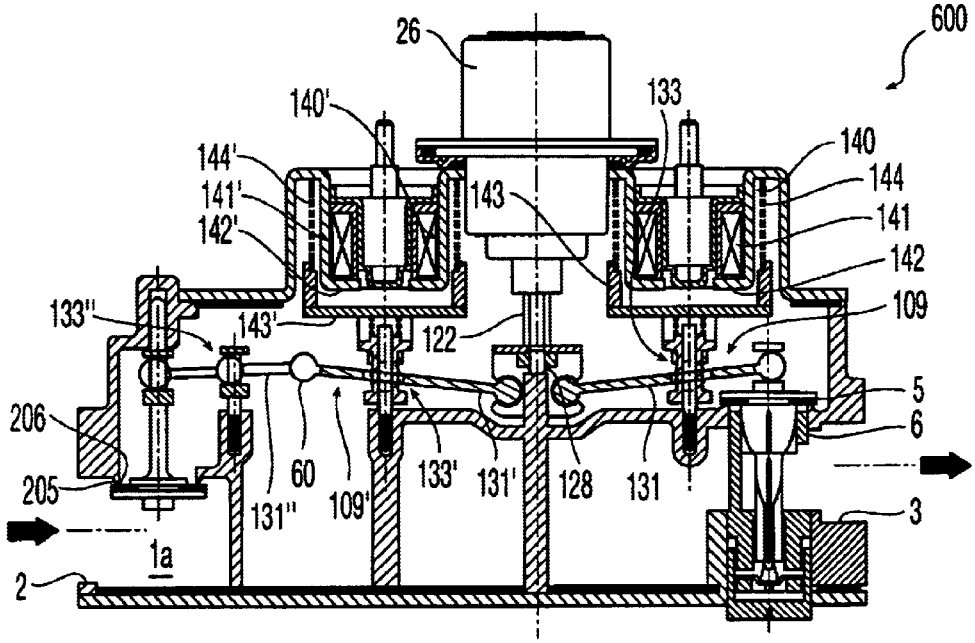
Figure 18:
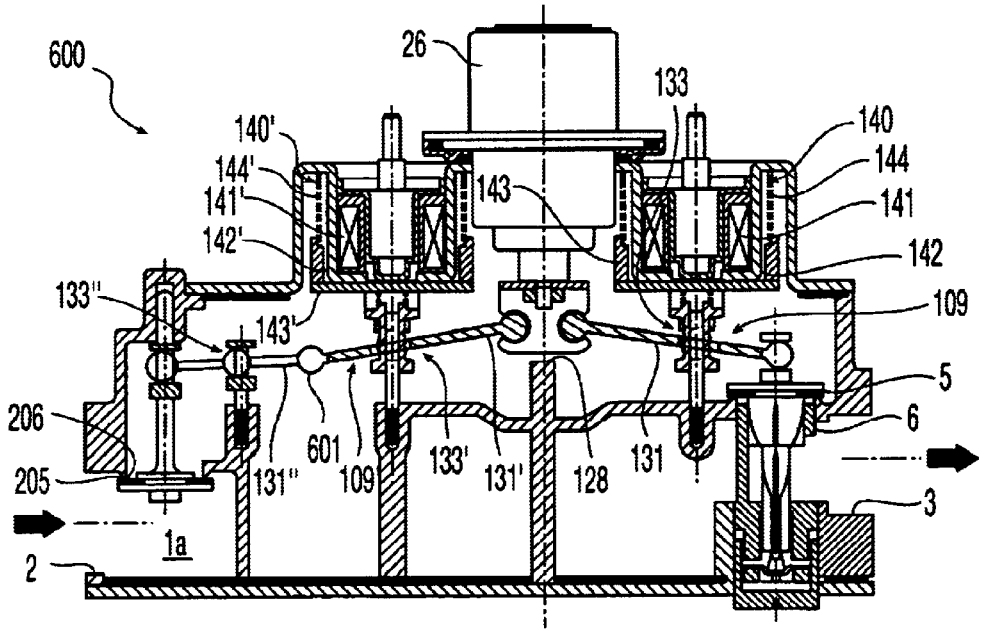
Figure 19:
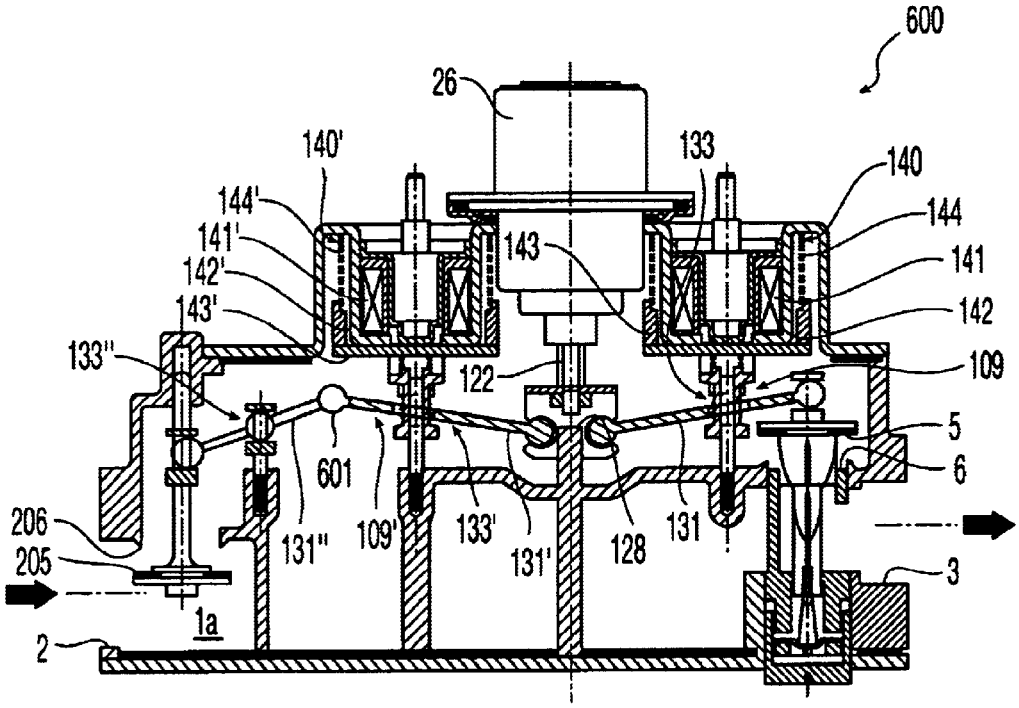

The characteristics and advantages of the invention will become clear from the following detailed description of some of its preferred exemplary embodiments illustrated by way of non-limiting example with reference to the appended drawings, in which:

FIG. 1 is a view in longitudinal section of a valve unit according to the invention, FIG. 2 is a view in longitudinal section of a first alternative embodiment of the valve unit of FIG. 1, FIGS. 3 to 6 are views in longitudinal section of a second alternative embodiment of the invention in different operating positions, FIGS. 7 to 10 are views in longitudinal section of a third alternative embodiment of the invention in different operating positions, FIGS. 11 to 13 are views in longitudinal section of a fourth alternative embodiment of the invention in different operating positions, FIGS. 14 to 16 are views in longitudinal section of a fifth alternative embodiment of the invention in different operating positions, FIGS. 17 to 19 are views in longitudinal section of a sixth alternative embodiment of the invention in different operating positions.

In FIG. 1, the reference 1 indicates as a whole a first example of a valve unit for controlling the delivery of a combustible gas to a burner or other similar consumer unit (not shown in the drawing), produced in accordance with the present invention. In the valve unit 1 there is defined a gas path 1*a* between a feed opening 2 and a delivery opening 3.

The unit 1 comprises a modulation valve 4 including a first closure means 5 urged so as to close a first valve seat 6, in the manner explained in detail hereinafter in the description. Upstream of the modulation valve 4 are provided, in a manner which is conventional per se, a safety solenoid valve 7 for the interception of the main flow of gas fed through the pipe 2 and a servo-valve 8. The provision and placing of the valves 7, 8, although constituting a preferred choice, does not constitute any limitation of the inventive concept on which the present invention is based.

The servo-valve 8 comprises a closure means 9 resiliently urged so as to close a seat 10 by the resilient load of a spring system 11 and controllable for opening by a diaphragm 12 sensitive to the pressure differential existing between the pressure $P_u$ in a chamber 13 downstream of the seat 10 on the one hand, and the value of the pressure $P_t$ in a pilot chamber 14 on the other hand.

The reference 15 indicates a regulating valve comprising a screw 16 for regulating the maximum value of the pressure $P_u$. By means of the screw 16, against which abuts a spring 17 acting in its turn on a diaphragm closure means support 18, a preselected resilient load is maintained on the diaphragm. Said load is proportional to a pressure value $P_u$ in the chamber 13. The closure means support 18 is displaceable so as to close a valve seat 19 which allows the chamber 13 to communicate with a second chamber 20. Said chamber 20 is always in communication with the pilot chamber 14 by way of a transfer 21 and is provided with a constriction 21*a* such as to induce a loss of load in order to derive the pilot pressure Pt from a fraction of the flow of gas tapped at the inlet of the valve unit from the amount fed through the pipe 2.

Returning now to the modulation valve 4, this comprises a first motor driven actuator means for the control of the closure means 5 including an operating rod 22. The rod 22 is provided with an external thread 22*a* capable of screwing engagement in a nut screw 23 provided internally on a bush 24. Said bush 24 is coaxial and rigidly connected to the rotor 25 of an electric motor 26. The latter is a direct current motor and preferably a motor of the stepping type. The operating rod 22 is connected by way of the screw/nut-screw coupling to the hollow shaft of the rotor 25 with preferably unitary transmission ratio.

The operating rod 22 is likewise provided with a pair of diametrically opposed radial protuberances 27 for the engagement of respective grooves 28 formed in a casing 29 rigidly connected to the stator portion of the motor. Owing to the sliding engagement of the protuberances 27 in the grooves 28, the operating rod 22 is guided along in the direction of its axial development in such a manner that, by the effect of the screw/nut-screw coupling, there corresponds to a rotation of the bush 24 a predetermined axial sliding of the operating rod 22.

Between the closure means 5 and the rod 22 there is interposed, according to the invention, a second electromagnetic actuator means 30 comprising an electromagnet with a solenoid 31, a substantially U-shaped fixed part (core) 32, and a movable part (armature) 33. The fixed core 32 is connected to one end of the rod 22 while the movable armature 33 is rigidly connected to the closure means 5. The motor 26, by way of the rod 22, brings the fixed part of the magnet 32 into contact with the armature 33, after which a reversal of the rotation of the motor effects the opening of the closure means 5.

The fixed core is kept anchored to the movable armature by the effect of the energizing of the electromagnet, counter to a spring system 34 acting on the closure means 5 to urge the latter to close the valve seat 6 when predetermined operating conditions occur, as explained in detail hereinafter.

The movable armature 33, and with it the closure means 5, is further axially guided by means of guides and counter-guides, indicated as a whole by 35.

The reference 36 indicates a spring acting between the casing 29 and a portion of the fixed core 32, located opposite the movable armature 33, and serving to maintain the corresponding flanks of the threads of the screw/nut-screw coupling in continuous and mutual contact, eliminating the play present in the coupling.

Designated by 37 is an adjustable abutment of the rod 22 which is provided on the surface of a screw 38 screwed into an axial threaded hole 39 of the casing of the motor 26.

In operation, provision is made for the motor 26 to be actuated in rotation for a pre-selected number of turns correlated, by means of the thread pitch in the screw/nut-screw coupling, to a predetermined axial stroke of the operating rod 22. The stroke executed by the rod is such as to bring the closure means 5 to the pre-selected distance from the valve seat in order to induce a predetermined and corresponding pressure differential between the chamber 13 and the delivery pipe 3, respectively located upstream and downstream of the seat 6, thus making it possible to modulate the delivery pressure $P_e$ in the pipe 3 and consequently the rate of flow of gas delivered to the consumer unit. Under normal operating conditions, the closure means 5 is anchored, by means of the armature 33, to the fixed core of the electromagnetic actuator 30, by the energizing of the solenoid 31.

When predetermined conditions occur which require the interception of the valve seat 6, the electrical supply to the solenoid 31 is interrupted, and consequently the closure means 5 is urged by the spring system 34 so as to close the seat 6, independently of the axial position of the operating rod 22. The modulation valve 4, in addition to the modulation function, thus performs the function of safety interception of the passage of gas through the seat 6.

In the valve unit according to the invention, therefore, double intrinsic safety or redundancy of protection is obtained, in the sense that even in default of the automatic intervention of the solenoid safety valve 7, the modulation valve 4 is nevertheless commanded for closure.

The spring system 34 is selected to have dimensions and elastic constant such as to be able to guarantee closure of the closure means 5 against the valve seat 6 starting from any axial position reached by the operating rod 22 during the modulation function.

With reference to FIG. 2, 100 indicates as a whole a first alternative embodiment of the valve unit according to the invention, in which details analogous to those of the preceding example are designated by the same reference numbers.

The valve unit 100 comprises a solenoid safety valve 107, for the interception of the flow of gas fed through the pipe 2 and a servo-valve 108, which valves are structurally and functionally equivalent respectively to the solenoid valve 7 and servo-valve 8 of the preceding example, and reference should therefore be made to said example for their detailed description.

The valve unit 100 further comprises a modulation valve 104 which differs from the valve 4 of the example in FIG. 1 principally in that the first motor driven actuator means, functionally analogous to the motor driven actuator of the valve unit 1, and the closure means 5 are operably connected to each other by way of a linkage, indicated as a whole by 109.

Analogously to the example in FIG. 1, the first motor driven actuator comprises an operating rod 122 coaxial with the rotor 25 of the motor 26 and connected thereto by way of a screw/nut-screw coupling so that to a preselected rotation of the rotor 25 there corresponds a predetermined axial sliding of the operating rod 122. Said rod 122 is provided with diametrically opposed radial protuberances 127 for engagement in respective grooves provided on the stator part of the rotor 25 and having the function of guides for the axial sliding of the rod 122.

The reference 128 indicates an abutment surface provided in a stationary structure 129 of the valve unit 100, facing the free end 122*b* of the rod 122 and constituting limiting means for the axial stroke of the rod itself.

At the end 122*b* there is mounted on the rod a body 130 constituting a first hinge coupling member for the linkage 109. More particularly, the linkage 109 comprises a lever 131 of the first kind having opposed ends 131*a,b,* of which the end 131*a* constitutes the second hinge coupling member of the lever 131 with respect to the body 130.

At the opposite end 131*b* the lever is connected, by means of an analogous hinge connection, to an end appendage 132 of the closure means 5.

It should be noted that the hinge connection is selected such that the lever 131 can pivot relative to the rod 122 and to the closure means 5 in a plane parallel to the direction of axial actuation of the rod 122, indicated by X in FIG. 2, and also of the closure means 5.

In the intermediate position between the opposed ends 131*a,b,* the lever is pivoted with respect to the stationary structure 129 by means of fulcrum means 133 which are in turn movable, integrally with the lever, with respect to the stationary structure, as will be seen more clearly in the continuation of the description.

The fulcrum means 133 comprise a pin 134 planted in the structure 129 on which is fitted and freely slidable, in a direction parallel to the axis X, a bush 135 having opposed flanged ends 135*a,b* between which abuts an intermediate portion of the lever 131. Said portion is shaped such that the lever is subject to a combined motion of translation, integrally with the bush 135 with respect to the pin 134, parallel to the axis X, and of pivoting with respect to the bush about an axis perpendicular to the direction of axial sliding.

The valve unit 100 further comprises a second electromagnetic actuator means 140, interposed between the rod 122 and the closure means 5 and comprising, analogously to the example in FIG. 1, an electromagnet with a solenoid 141, a fixed part (core) 142 and a movable part (armature) 143.

The fixed part is magnetizable and is held anchored to the movable armature 143 by the effect of the energizing of the electromagnet, counter to a spring system 144.

The armature 143 is rigidly connected to the bush 135 or, alternatively, by way of a second spring system 145 as illustrated in FIG. 2. Said spring system 145 serves to bring the armature 143 into contact with the fixed part of the magnet 142 with a predetermined force such as to allow the motor 26 to reach an end of stroke position.

It should be noted how the armature 143 of the second electromagnetic actuator means 140 acts directly on the fulcrum means 133 and, integrally with the latter, on the lever 131 to pivot the latter with respect to the operating rod 122 about the corresponding hinge and consequently to displace the closure means 5 so as to close the first valve seat 6 independently of the operating position of the first motor driven actuator means.

According to a preferred embodiment of the invention, the fixed part (core) 142 of the electromagnet is obtained in one piece with a cover 149 provided to close a housing of the valve unit, indicated by 150 in the drawings, in which is defined the gas passage 1*a*. In this way the cover 149 is shaped so as to constitute the housing for the solenoid 141 and form an integral part of the electrical magnetization circuit. Said cover 149 is mounted so as to be gas-tight on the housing in such a manner that the electrical supply circuit of the solenoid 141 is maintained outside the housing without any contact with the gas which flows in the passage 1*a* inside the housing.

In operation, with the electromagnet energized, provision is made for the motor 26 to be actuated in rotation for a pre-selected number of turns correlated, by means of the thread pitch in the screw/nut-screw coupling, to a predetermined axial stroke of the operating rod 122. The stroke executed by the rod is therefore transformed into pivoting of the lever 131 and consequently, by means of the ratio of the lever arms with respect to the fulcrum, into a corresponding correlated stroke of the closure means 5, which is displaced to a pre-selected distance from the valve seat 6 such as to permit the modulation of the delivery pressure and consequently of the flow rate of gas delivered.

To discharge the function of modulation of the pressure the closure means 5 is likewise provided with an ogive shape 151 extending coaxially within the valve seat 6 and such as to determine an annular gas outlet section having a size correlated to the axial stroke of the closure means 5. Preferably, the closure means 5 is provided with a double ogive profile, one extending as a prolongation of the other, to permit a greater degree of modulation of the delivery pressure. The closure means 5 is displaced so as to close the valve seat 6 counter to a spring 146 abutting a spring-holder 147 adjustable by means of a screw 148 having a conventional structure per se.

When predetermined conditions occur which require the interception of the valve seat 6, the electrical supply to the solenoid 141 is interrupted and consequently the movable armature 143 is pushed by the resilient action of the spring system 144 so as to pivot the lever 131 about its hinge point with the rod 122 and displace the closure means 5 so as to close the seat 6, independently of the axial position of the operating rod 122.

Also in this alternative embodiment of the invention, the modulation valve 104 thus discharges, in addition to the modulation function, the function of safety interception of the gas passage 1*a* through the seat 6. As in the example of FIG. 1, the modulation valve 104 is therefore commanded for closure.

The spring system 144 is selected to have dimensions and elastic constant such as to be able to guarantee closure of the closure means 5 against the valve seat 6, starting from any position reached by the lever 131 and consequently by the rod 122 during the modulation function.

It should also be noted that the provision of the linkage 109 makes it possible, with suitable selection of the ratio of the lever arms 131, to increase the thread pitch of the screw/nut-screw coupling (between rod and rotor) in parity with the stroke of the closure means 5, with respect to the solution with direct coupling in FIG. 1. As a result, this alternative embodiment of the invention guarantees effective actuation also in the starting phases of the motor 26 and in particular in the reversal of the motion of the rod 122 by reason of the lesser starting torques owing to the selection of the pitch of the screw/nut-screw coupling.

In addition, through the linkage 109, with a suitable ratio of the lever arms, it is possible to obtain greater resolution in the positioning of the closure means 5, with a consequently greater accuracy of the modulation of the pressure and of the flow rate delivered.

A further advantage obtained by this variant is due to the fact that the winding of the solenoid of the second electromagnetic actuator means is rigidly connected to the stationary part of the valve unit, thus facilitating the electrical supply thereof.

FIGS. 3 to 6 show a second alternative embodiment of the valve unit according to the invention, indicated as a whole by 200 and in which details analogous to those of the preceding examples are designated by the same reference numbers.

The valve unit 200 differs from the unit 100 in that the first motor driven actuator means is arranged to control, in addition to the closure means 5, also a second closure means 205 for the closing and opening of a respective valve seat 206.

The rod 122 is operably connected to the closure means 5, 205 by way of a pair of respective linkages 109, 109' structurally and functionally equivalent to the linkage described in the example of FIG. 1, and this is to be referred to for a detailed description. For greater simplicity, the details of the linkage 109' are shown with the same reference numbers as the details of the linkage 109, but with the addition of a prime.

It should be noted that the levers 131, 131' are hinged to the same body 230 rigidly connected to the free end of the rod 122.

The closure means 205 is functionally analogous to the closure means 9 of the example in FIG. 1 and principally performs the function of ON/OFF interception of the gas passage. It is arranged upstream of the modulation valve 104 and is urged so as to close the seat 206 by a spring 207, such structure being in no way limiting, and the closure means 205 being alternatively able to be produced analogously to the closure means 9 of FIG. 1.

The reference 140' indicates a third electromagnetic actuator means, structurally and functionally equivalent to the second actuator means 140 of the preceding example which acts on the second linkage 109' in the manner described above with reference to the second electromagnetic actuator means 140.

Figure 3:
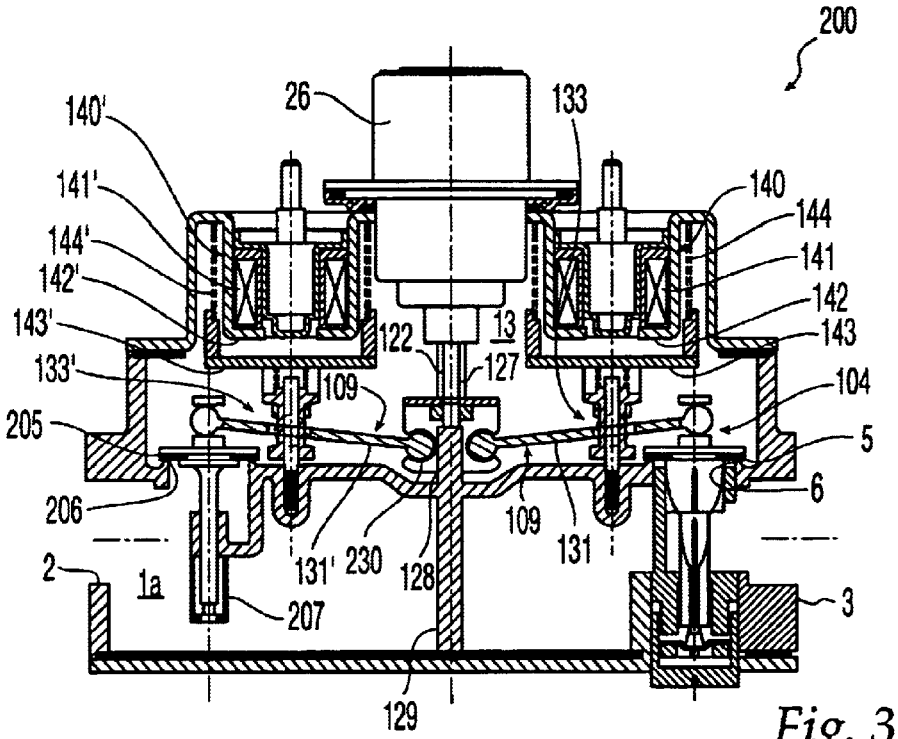
Figure 4:
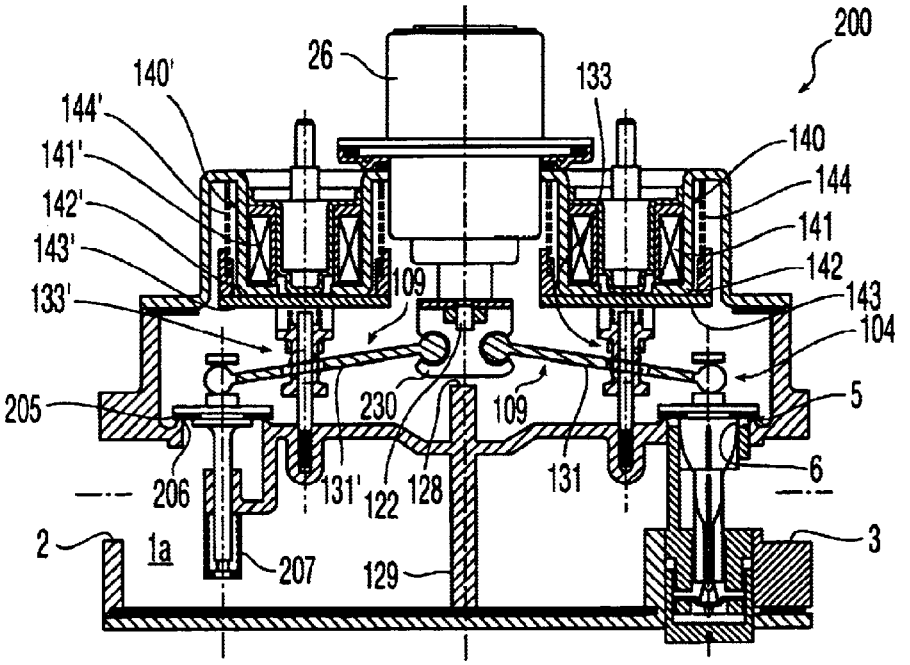

In FIG. 3, the valve unit 200 is shown in a first, non-operative position in which the closure means 5, 205 are urged so as to close the respective valve seats with interception of the gas passage 1*a*. In this position the second and the third electromagnetic actuator means 140, 140' are energized, but the respective movable armatures 143, 143' are outside the area of influence of the magnetization of the respective air gap and are not therefore attracted towards the fixed core 142, 142' of the electromagnet. The movable armatures, by means of the spring systems 144, 144', urge the closure means 5, 205 into the closure position.

Starting from this position, by actuation in rotation of the motor 26, the operating rod 122 is displaced away from the surface 128 with consequent pivoting of the levers 131, 131' about the hinge points with the respective closure means. The pivoting effects the approach of the movable armatures 143, 143' to the respective fixed cores 142, 142' and by the effect of electromagnetic attraction, locking of the armatures on the electromagnets takes place, as shown in the operating position in FIG. 4.

Figure 5:
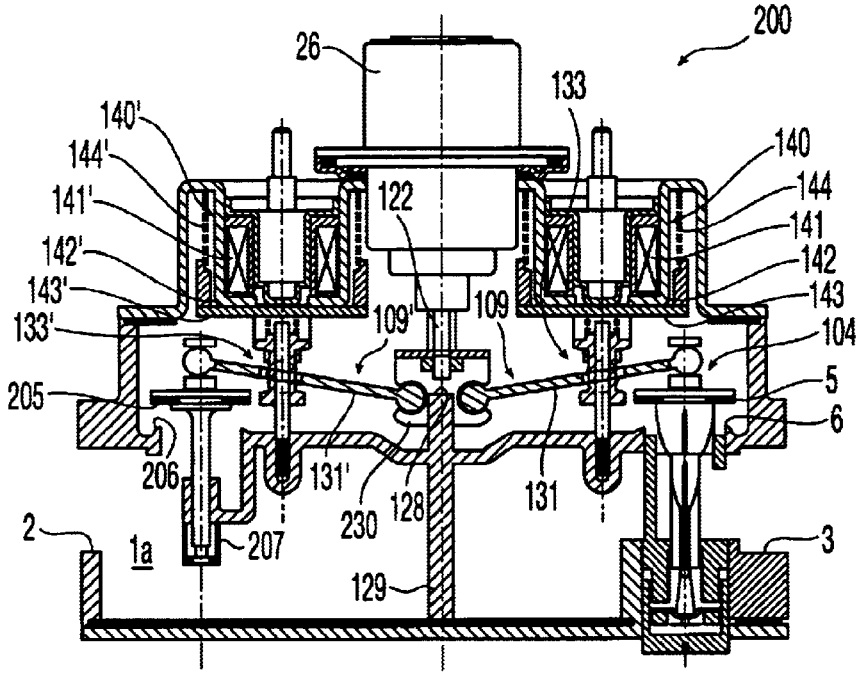
Figure 6:
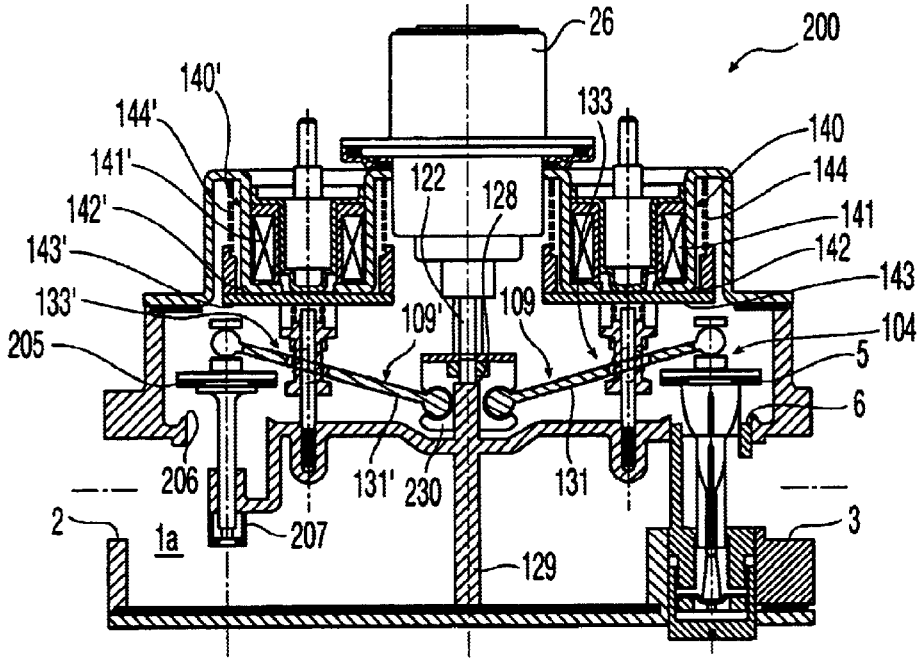

From this position, the actuation in rotation of the motor 26 and the consequent axial sliding of the rod 122 makes it possible to regulate the opening of the closure means 5, 205 by performing the functions of regulation and modulation of the pressure and of the flow rate delivered. It should be noted how, with a single motor driven actuator means, there is obtained the concomitant control of the closure means 5, 205, the first for the function of opening/closing of the gas passage, and the second also for the modulation function. In this position, the fulcrum means 133, 133' are maintained in a fixed position with respect to the stationary structure 129 and the levers 131, 131' are pivoted in the control of the respective closure means about the corresponding fulcrum means (FIG. 5). In FIG. 6, the unit 200 is shown in the position of maximum opening of the closure means 5, with the rod 122 abutting the stroke end abutment 128.

When predetermined conditions occur which require the interception of the flow of gas through the passage 1*a,* and the closure of the closure means 5, 205 is therefore required, the electrical supply to the solenoids 141, 141' is interrupted and consequently the movable armatures 143, 143' are urged by the spring systems 144, 144' to pivot each respective lever 131, 131' about their hinge points with the rod 122 so as to cause the corresponding closure means 5, 205 to close the respective valve seat 6, 206, independently of the axial position of the operating rod 122. The safety closure of both the closure means 5, 205 is thus ensured, starting from any position reached by the rod 122 during the operation of the valve unit.

A further advantage obtained by this alternative embodiment lies in the fact that both the valves of the unit are controlled by a single motor driven actuator with consequent limited energy consumption, which further makes it possible to provide a supply with battery or by means of circuits for generating energy internally with thermopile or fuel cell. This is advantageously permitted also by the fact that the electromagnets used have exclusively the function of holding electromagnets, with consequent low consumptions and reduced supply power.

The provision according to the invention of a stepping motor for the modulation control further makes it possible to limit the energy consumption inasmuch as the motor absorbs energy exclusively in the phases of passage from one modulation regulation to the next, and does not therefore have a constant consumption of energy such as that which is found in the known solutions which do not provide such actuators with stepping motor.

FIGS. 7 to 10 show a third alternative embodiment of the valve unit according to the invention, indicated as a whole by 300 and in which details analogous to those of the preceding examples are designated by the same reference numbers.

The valve unit 300 differs from the unit 200 principally in that the first motor driven actuator means 26, 122 acts directly on the second closure means 205 without the interposition of any linkage. More particularly, the second closure means 205 is coaxial with the operating rod 122 of the motor 26 as well as with the third electromagnetic actuator means 140', as illustrated in FIG. 7.

The reference 301 indicates an abutment surface against which the operating rod 122 abuts by way of the body 230 capable of connecting by a hinge the linkage 109.

According to the structure of this variant of the invention, the second closure means 205 is mounted in the valve unit in such a manner as to be displaced so as to close the respective valve seat 206 in the same direction as the direction of the flow of gas fed through the feed opening 2. The result is that the closure of the closure means 205 takes place in favour of gas in the sense that the closure means itself is urged so as to close the respective valve seat, not only by the resilient force of the electromagnet actuator 140' but also by the contribution of pressure of the gas present in the feed pipe.

Figure 7:
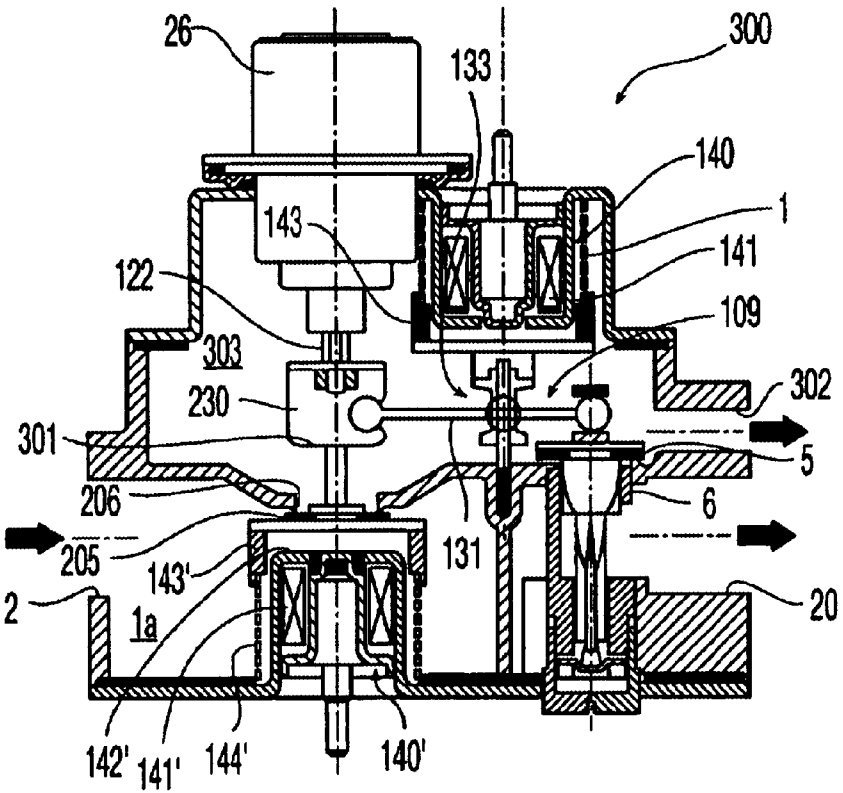

In FIG. 7 the valve unit 300 is shown in a first, non-operative position in which both the closure means 5, 205 are urged so as to close the respective valve seats with interception of the gas passage 1*a*. In this position the second and the third electromagnetic actuator means 140, 140' are energized but the respective movable armatures 143, 143' are outside the area of influence of the magnetization of the respective air gap and are not therefore attracted towards the respective fixed core 142, 142' of the electromagnet. The movable armatures, by means of the spring systems 144, 144', urge the closure means 5, 205 into the closure position.

Figure 8:
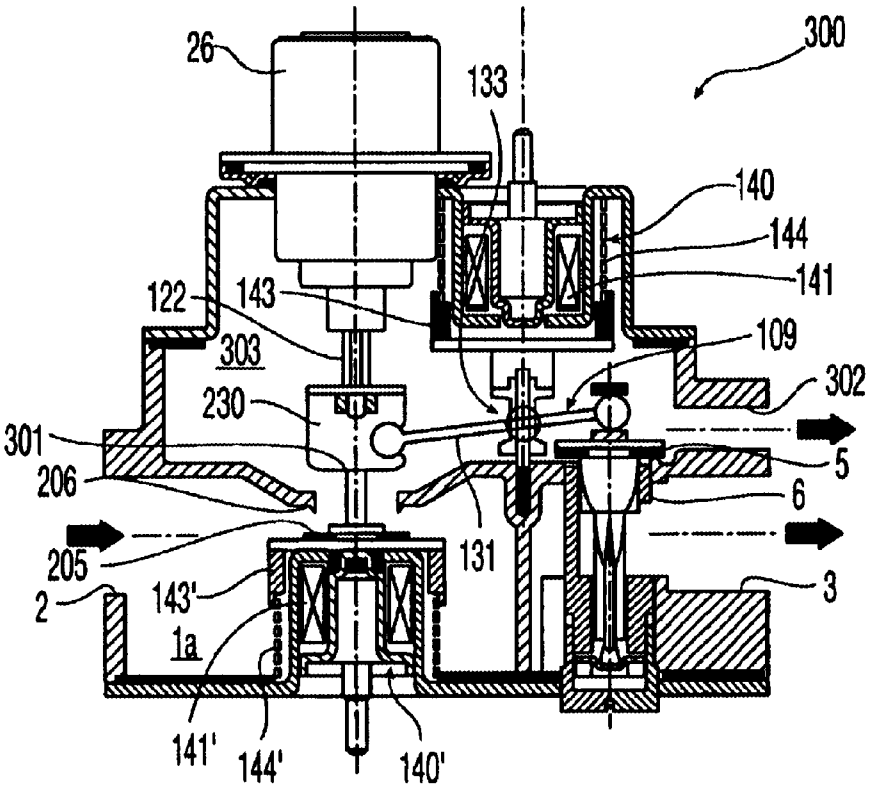

Starting from this position, by actuation in rotation of the motor 26, the operating rod 122 is displaced to urge the closure means 205 axially against the resilient action of the spring system 144' by bringing the movable armature 143' closer to the respective fixed core 142', effecting the locking of the armature on the electromagnet and the opening of the valve seat 206, as illustrated in FIG. 8. During this arming stroke the lever 131 is pivoted about the hinge point with the respective first closure means 5.

Figure 9:
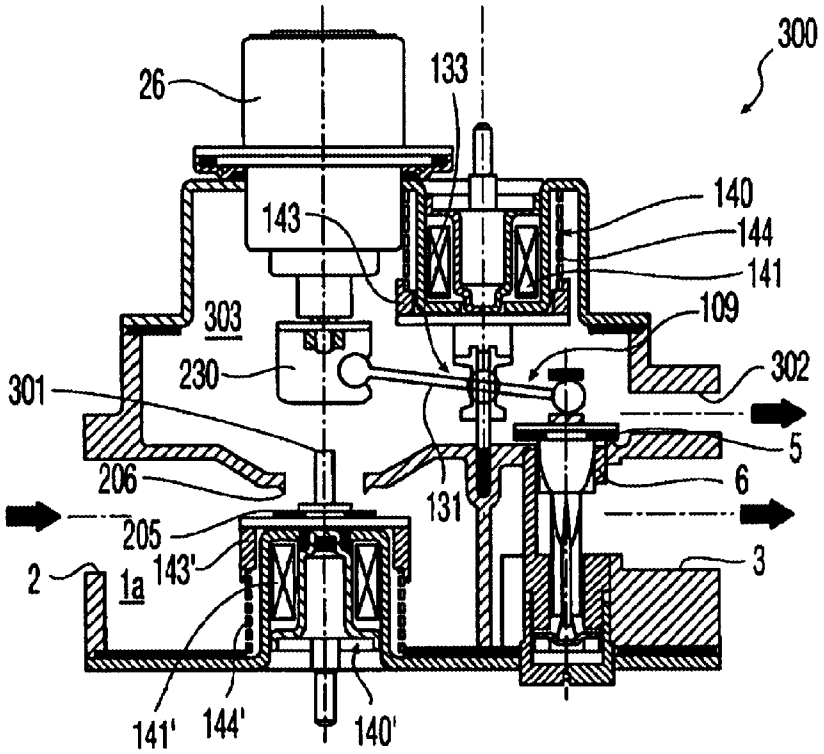

From this position (FIG. 8), actuation in counter-rotation of the motor 26, with the consequent axial sliding of the rod 122 away from the abutment surface 301, allows the lever 131 to be pivoted about the hinge point with the first closure means, effecting the locking of the armature 143 to the respective fixed core 142, as illustrated in FIG. 9. From this position the actuation in rotation of the motor 26 and the consequent axial sliding of the rod 122 makes it possible to regulate the opening of the first closure means 5 by performing the functions of regulation and modulation of the pressure and of the flow rate delivered (FIG. 10). It should be noted how the opening of the closure means 5, 205 is sequential and not concomitant as in the valve unit 200.

When predetermined conditions occur which require the interception of the flow of gas through the passage 1*a,* and the closure of the closure means 5, 205 is therefore required, the electrical supply to the solenoids 141, 141' is interrupted and consequently the movable armatures 143, 143' are urged by their respective spring systems 144, 144'. In particular, the lever 131 is pivoted about the hinge point with the rod 122 so as to cause the corresponding closure means 5 to close the respective seat 6, while the second closure means 205 is directly urged to close the respective seat 206. It should be noted that in this phase the closure of the valve seats 6, 206 occurs independently of the axial position of the operating rod 122, thus ensuring the safety closure of both the closure means 5, 205, starting from any position reached by the rod 122 during operation.

Since the opening of the valve seats occurs sequentially it is advantageously possible to provide in this alternative embodiment an auxiliary opening 302 for connection, for example, to a pilot burner, not shown in the drawings. Said opening 302 communicates with a chamber 303 of the passage 1*a* in which the valve seats 6, 206 are provided.

FIGS. 11 to 13 show a fourth alternative embodiment of the valve unit according to the invention, indicated as a whole by 400 and in which details analogous to those of the preceding examples are designated by the same reference numbers.

The valve unit 400 differs from the unit 200 principally in that the third electromagnetic actuator means 140' is arranged on the opposite side relative to the lever 131' with respect to the configuration assumed in the unit 200. In the unit 400 the second and the third electromagnetic actuator means 140, 140' are therefore mounted in symmetrically opposed positions with respect to a notional plane of containment of the linkages 109, 109', as illustrated in FIG. 11.

Furthermore, analogously to the preceding example, the second closure means 205 is mounted in the unit 400 in a position such as to be displaceable so as to close the valve seat 206 in favour of gas, that is to say, with a stroke for closing the valve seat in the same direction as the direction of flow of gas supplied through the feed opening 2.

In FIG. 11 the unit 400 is shown in a first, operating position in which both the closure means 5, 205 are urged to close the respective valve seats with interception of the gas passage 1*a* and in which the third electromagnetic actuator 140' has been armed by means of a stroke of the operating rod 122 of the motor such as to bring the movable armature 143' closer to the respective fixed core 142' to lock the movable armature to the respective electromagnet.

From this position, actuation in counter-rotation of the motor 26, with the consequent sliding of the operating rod 122 away from the surface 128, makes it possible on the one hand to pivot the lever 131' about the fulcrum 133', effecting the opening of the first valve seat 206, and on the other hand to pivot the lever 131 about the hinge point with the first closure means 5, effecting the approach of the movable armature 143 to the respective fixed core 142 with the consequent arming of the second electromagnetic actuator means 140 (FIG. 12). It should be noted how in this operating position, with arming of both the electromagnetic actuators, the second valve seat 206 is opened while the first seat 6 is still intercepted by the respective closure means 5, such as to effect, in this example also, sequential opening of the closure means.

From this position, further actuation in rotation of the motor 26, with consequent axial sliding of the operating rod 122, allows the opening of the first valve seat 6 and the regulation of the opening of both the closure means 5, 205 by performing the operations of regulation and modulation of the pressure and of the flow rate delivered (FIG. 13).

When predetermined conditions occur which require the interception of the flow of gas through the passage 1*a,* and the closure of the closure means 5, 205 is therefore required, the electrical supply to the solenoids 141, 141' is interrupted and consequently the movable armatures 143, 143' are urged by their respective spring systems. In particular, both the levers 131, 131' are pivoted about their hinge points with the rod 122 so as to cause each corresponding closure means 5, 205 to close the respective valve seat 6, 206. In this case also, the interception of the valve seats occurs independently of the axial position of the operating rod 122, thus ensuring the safety closure of both the closure means, starting from any position reached by the rod 122 during operation.

Owing to the sequentiality of opening of the closure means 5, 205 it is possible advantageously to provide also in this alternative embodiment an auxiliary opening 402 for connection, for example, to a pilot burner, in which said opening communicates with a chamber 403 provided in the gas passage 1*a* and in which the valve seats 6, 206 are open.

Another advantage obtained with this alternative embodiment consists in being able to obtain concomitant regulation of both the sections of the valve seats 6, 206, obtaining greater facility and greater accuracy of regulation and modulation of the pressure and of the flow rate delivered.

FIGS. 14 to 16 show a fifth alternative embodiment of the valve unit of the present invention, indicated as a whole by 500 and in which details analogous to those of the preceding examples are designated by the same reference numbers.

The valve unit 500 differs from the unit 200 principally in that the positioning of the second closure means 205 and of the third electromagnetic actuator means 140' is inverted reciprocally relative to the respective hinge points with the linkage 109'. More particularly, the second closure means 205 is associated with the fulcrum means 133' and is mounted in the unit 500 in a position such as to be displaceable so as to close the valve seat 206 in favour of gas, that is to say, with a seat closure stroke in the same direction as the direction of flow of gas supplied through the feed opening 2.

Furthermore, the electromagnetic actuators 140, 140' reflect the reciprocal positioning with respect to the linkages 109, 109' assumed in the configuration of the unit 400.

In FIG. 14, the unit 500 is shown in a first, non-operative position in which both the closure means 5, 205 are urged to close the respective valve seats with interception of the gas passage 1*a*.

From this position, actuation in rotation of the motor 26, with the consequent axial sliding of the operating rod 122 away from the surface 128 makes it possible to pivot both the levers 131, 131' about the respective fulcrum means 133, 133', bringing each movable armature 143, 143' closer to the respective fixed core 142, 142' with the consequent concomitant arming of both the electromagnetic actuators 140, 140'. In this phase the valve seats 6, 206 remain intercepted by the respective closure means 5, 205.

From this position, actuation in counter-rotation of the motor 26, with corresponding axial sliding of the rod 122, allows, by means of pivoting of the levers about the hinge points with the respective closure means, the concomitant opening of the valve seats 6, 206, to perform the functions of regulation and modulation of the pressure and of the flow rate delivered (FIG. 16).

When predetermined conditions occur which require the interception of the flow of gas through the passage 1*a,* and the closure of the closure means 5, 205 is therefore required, the electrical supply to the solenoids 141, 141' is interrupted and consequently the movable armatures 143, 143' are urged by the respective spring systems 144, 144'. The result is that the levers 131, 131' are pivoted about their hinge points with the rod 122 such as to displace each closure means 5, 205 so as to close the respective valve seat 6, 206. In this case also, the interception of the valve seats occurs independently of the axial position of the operating rod 122, thus ensuring the safety closure of both the closure means, starting from any position reached by the rod 122 during operation.

FIGS. 17 to 19 show a sixth alternative embodiment of the valve unit of the present invention, indicated as a whole by 600 and in which details analogous to those of the preceding examples are designated by the same reference numbers.

The valve unit 600 differs from the unit 200 principally in that the second linkage 109' comprises a second lever 131" which extends to the lever 131' and is hinged thereto by way of one of its ends at an articulation point 601. Said second lever 131" is also pivoted about a fixed fulcrum 133" and is hinged, at the opposite end, to the second closure means 205 (FIG. 17).

It should be noted how, also in this embodiment, the second closure means 205 is mounted in the unit 600 in a position such as to be displaceable so as to close the valve seat in favour of gas, that is to say, with a stroke for closing the valve seat in the same direction as the direction of flow gas supplied through the feed opening 2.

In the FIG. 17 the unit 600 is shown in a first operating position in which both the closure means 5, 205 are urged to close the respective valve seats with interception of the gas passage 1*a*.

From this position, a first actuation in rotation of the motor 26, with the consequent axial sliding of the rod 122 away from the surface 128, allows the levers 131, 131' to be pivoted about the fulcrum 133 and the articulation point 601, respectively, effecting the approach of each armature 143, 143' to the respective fixed core 142, 142' with the concomitant arming of both the electromagnetic actuator means 140, 140'.

In this phase the valve seats are intercepted by the respective closure means 5, 205.

From this position, actuation in counter-rotation of the motor 26, with the corresponding axial sliding of the rod 122, makes it possible, by means of pivoting of the levers 131, 131' and 131" about the respective fulcrum 133, 133" and 601, the concomitant opening of the valve seats 6, 206 to perform the functions of regulation and modulation of the pressure and of the flow rate delivered (FIG. 19).

When predetermined conditions occur which require the interception of the flow of gas through the passage 1*a,* and the closure of the closure means 5, 205 is therefore required, the electrical supply to the solenoids 141, 141' is interrupted and consequently the movable armatures 143, 143' are urged by their respective spring systems 144, 144'. The result is that the levers 131, 131' are pivoted about their hinge points with the rod 122 such as to displace each closure means 5, 205 so as to close the respective valve seat 6, 206.

In this phase the second closure means 205 is displaced by a composite pivoting of the levers 131 and 131' about the hinge point with the rod 122 and about the fulcrum 133", respectively. It should be noted how the interception of the valve seats 6, 206 occurs independently of the axial position of the operating rod 122, thus ensuring the safety closure of both the closure means, starting from any position reached by the rod 122 during operation.

What is claimed is:

1. A valve unit for controlling the delivery of a combustible gas, including a gas path between a feed opening and a delivery opening, the unit comprising:

a first valve seat in said gas path and a first closure means associated with said first seat, a first actuator means for the control of said first closure means for opening and closing said first valve seat, motor means for the operating control of said first actuator means, characterized in that they comprise a second electromagnetic actuator means interposed between said first closure means and said first actuator means to urge said first closure means so as to close said first valve seat independently of the operating position of the first actuator means, when a predetermined condition occurs which requires the interception of said first valve seat.

2. A valve unit according to claim 1, wherein said motor means comprise a direct current motor.

3. A valve unit according to claim 2, wherein said motor is a stepping motor.

4. A valve unit according to claim 2, wherein said motor is a motor with reversible rotation.

5. A valve unit according to claim 1, wherein the first actuator means comprises an operating rod and a screw/nut-screw coupling between a rotor of the motor and said operating rod, said rod being rigidly connected to one of said screw and screw-nut.

6. A valve unit according to claim 5, wherein said second electromagnetic actuator means comprises an electromagnet with a magnetizable fixed part integral with the first actuator means and a second, movable part, said second part being able to be rigidly connected to the fixed part of the first actuator means, as a consequence of the energizing of the electromagnet, counter to resilient means acting on said first closure means to urge the latter to close the said first seat.

7. A valve unit according to claim 6, wherein said rod is rigidly connected to the fixed part of said electromagnet.

8. A valve unit according to claim 6, wherein the movable part of the electromagnet is integral with the first closure means.

9. A valve unit according to claim 5, comprising guide means for guiding the operating rod axially in the control of said closure means as a result of rotation of the rotor about its own axis.

10. A valve unit according to claim 5, comprising a second valve seat in said gas path and a respective second closure means associated with said second seat, said first motor driven actuator means acting directly on said second closure means to control the latter for opening/closing of said second valve seat.

11. A valve unit according to claim 10, comprising a third electromagnetic actuator means arranged coaxially with said second closure means and said operating rod, said second closure means being interposed between said operating rod and said third electromagnetic actuator.

12. A valve unit according to claim 10, wherein the control for opening said first and second closure means occurs sequentially by means of the actuation of said first motor driven actuator means.

13. A valve unit according to claim 10, wherein said second closure means is associated with the corresponding valve seat so as to have a stroke for closing said seat directed in the same direction as the direction of the flow of gas supplied through said valve seat.

14. A valve unit according to claim 13, comprising an auxiliary opening communicating with a chamber provided in said gas passage and in which said first and second valve seat are open.

15. A valve unit according to claim 1, wherein said first actuator means and said first closure means are operably connected to each other by way of a first linkage, said second electromagnetic actuator means acting on said linkage.

16. A valve unit according to claim 15, wherein said first linkage comprises a lever of the first kind including first and second hinge connection means respectively between the lever and the first actuator means and between the lever and the first closure means, fulcrum means being associated with the lever, in an intermediate position thereof, to pivot the lever in the operating control of said first closure means.

17. A valve unit according to claim 16, wherein said fulcrum means are movable relative to a stationary structure of the valve unit.

18. A valve unit according to claim 17, wherein said fulcrum means are movably guided in a direction substantially parallel to the direction of actuation of said first closure means.

19. A valve unit according to claim 17, further comprising:

a second valve seat in said gas path and a respective second closure means associated with said second seat, said first and second closure means being operably connected to said first actuator means by way of a respective first and second linkage, and a third electromagnetic actuator means, said second and third electromagnetic actuator means acting respectively on the first and second linkage.

20. A valve unit according to claim 19, wherein each of said linkages comprises a respective lever of the first kind including respective first and second hinge connection means between each lever and the first actuator means and between each lever and the corresponding first and second closure means, fulcrum means being associated with each respective lever in an intermediate position of the latter, to pivot each lever in the operating control of the corresponding closure means.

21. A valve unit according to claim 20, wherein the fulcrum means of each respective lever are movable relative to a stationary structure of the valve unit.

22. A valve unit according to claim 20, wherein said second linkage comprises a first and a second lever extending one to another and reciprocally articulated, fulcrum means being associated with each respective lever of said second linkage, said second closure means being connected by means of hinge connection to said second lever at the opposite side to the first lever with respect to the corresponding fulcrum means.

23. A valve unit according to claim 19, wherein said second and third electromagnetic actuator means act on the respective fulcrum means to pivot the corresponding lever with respect to the first actuator means, about the corresponding first hinge means, and consequently displace each closure means so as to close the respective valve seat, independently of the operating position of the first actuator means, when said condition occurs which requires the interception of said valve seats.

24. A valve unit according to claim 19, wherein said second closure means is connected to the corresponding linkage at said fulcrum means, said third electromagnetic actuator means acting on the linkage on the opposite side from the hinge connection with the operating rod with respect to the fulcrum means.

25. A valve unit according to claim 19, wherein the control for closing and opening of said first and second closure means occurs concomitantly by means of the actuation of said first motor driven actuator means.

26. A valve unit according to claim 16, wherein said second electromagnetic actuator acts on said fulcrum means to pivot the lever with respect to the first actuator means, about said first hinge means, and consequently displace said first closure means so as to close said first seat, independently of the operating position of the first actuator means, when said condition occurs which requires the interception of said first valve seat.

27. A valve unit according to claim 16, wherein said second electromagnetic actuator means comprises an electromagnet with a magnetizable fixed part and a second, movable part, said second part being able to be rigidly connected to the first part as a consequence of the energizing of the electromagnet, said movable part being rigidly connected to said fulcrum means.

28. A valve unit according to claim 27, comprising a housing in which said gas passage is defined and a cover for closure of said housing, the fixed part of the electromagnet capable of anchorage by magnetization with the movable part being provided in one piece with said cover.

* * * * *